United States Patent [19]

Harter et al.

[11] 4,353,411

[45] Oct. 12, 1982

[54] ARCHITECTURAL SUPPORT AND SERVICE ASSEMBLY

[76] Inventors: James L. Harter, 3131 Diamond Ave., Allentown, Pa. 18103; Joseph E. Biro, Crescendo, Wittman, Md. 21676

[21] Appl. No.: 118,440

[22] Filed: Feb. 4, 1980

[51] Int. Cl.[3] ..... F25B 29/00

[52] U.S. Cl. ..... 165/48 R; 52/221; 98/33 R; 62/263; 165/129; 165/60

[58] Field of Search ..... 165/48 R, 60, 129; 62/262, 259, 263; 98/33 R, 31; 52/221

[56] References Cited

U.S. PATENT DOCUMENTS

| | | | |
|---|---|---|---|
| 2,635,524 | 4/1953 | Jenkins | 98/33 R |
| 2,708,568 | 5/1955 | Marshall | 165/48 |
| 2,877,990 | 3/1959 | Goemann | 165/48 |
| 3,195,698 | 7/1965 | Codrea | 189/34 |
| 3,289,368 | 12/1966 | Mark | 52/220 |
| 3,354,947 | 11/1967 | McKinnon | 98/33 R |
| 3,609,211 | 9/1971 | Van Herk | 174/49 |
| 3,897,820 | 5/1975 | Teeter, Jr. | 165/56 |
| 4,135,440 | 1/1979 | Schmidt et al. | 98/31 |

FOREIGN PATENT DOCUMENTS

| | | | |
|---|---|---|---|
| 2618833 | 11/1977 | Fed. Rep. of Germany | 52/221 |

*Primary Examiner*—Albert J. Makay
*Assistant Examiner*—Henry Bennett
*Attorney, Agent, or Firm*—Richard T. Muller

[57] ABSTRACT

A modular, dual-purpose architectural assembly which can provide support for basic structural elements used in constructing semi-permanent, enclosed or partially enclosed partitions defining parochial work spaces within a room and which can also supply discretely controlled heating, ventilation and air conditioning (HVAC) service, on a parochial basis, to said work space in response to local needs and varying conditions. The assembly consists of an upright, rigid, portable, elongated column which can be releasably mounted to the floor or ceiling of a room and attached to a subsurface (i.e., below the floor or above the ceiling in the room) HVAC supply system, said column having an interior channel extending longitudinally therethrough for carrying fluid from an inlet port at the base end of said channel, which inlet port is releasably connected to said HVAC supply system. The HVAC fluid supplied to the column is carried through said channel to an exhaust port where it is vented to the immediate exterior of said column. The channel and the exhaust port include a means for discretely controlling the rate of exhaust (volume) and direction of flow of the HVAC fluid from the column. The subsurface HVAC supply system carries HVAC fluid from a remote generating source to the inlet port of the service column via a network of regional stationary ducts and a moveable duct adapted to be releasably connected to the inlet port of the column at a plurality of access points in the floor or ceiling throughout the room, this enabling one to locate the assembly at a variety of locations.

2 Claims, 6 Drawing Figures

HVAC
HVAC
HVAC
HVAC
FROM
HVAC GENERATION
SOURCE 16
AXIS
OF ROTATION
OF DAMPER

HVAC
HVAC

HVAC
GENERATION
SOURCE
HVAC

ARCHITECTURAL SUPPORT AND SERVICE ASSEMBLY

BACKGROUND OF THE INVENTION

A. Field of the Invention

This invention relates to partition structures for rooms in office buildings and the like and more particularly to modular assembly for forming an integral part of such partitions and providing heating, ventilating and air conditioning service (HVAC) thereto. The assembly includes a portable, modular service column which can be releasably attached to a subsurface (above the ceiling or below the floor) HVAC supply system. The column can be used alone or as an integral structural element along with walls, partitions and dividers to fabricate a wide variety of rooms, enclosed areas, office partitions and room dividers, and at the same time supply heating, ventilation and air conditioning from the subsurface system to the work space immediately adjacent to the column. One of the primary features of the assembly is that it is portable; i.e., the column can be releasably connected to the floor or ceiling the HVAC supply system at a variety of locations. At the same time, the column's modular features are adapted to support one or more modular partitions or walls while providing HVAC fluid service. The assembly can be used in the fabrication of a wide variety of work environments from modular elements; any physically feasible and desired configuration can be readily assembled, disassembled and moved to different locations in a room having an "access" floor or "drop" ceiling with a subsurface, mobile HVAC supply system.

The modular assembly according to the present invention is a simple structural support element which provides HVAC service and has the desirable attributes of flexibility, mobility, economy of means, and aesthetic appeal. These attractive features are provided by the combining of modular elements in the assembly, including an elongated support and service column having an internal channel running longitudinally through the column. The channel can carry HVAC fluid from a subsurface HVAC supply system system, through the column for venting via an exhaust port to the immediate exterior of the column. The interior channel has an inlet port at its base which can be releasably connected to a moveable HVAC duct which is part of a duct network comprising of the HVAC supply system. Further, means are provided in the service column for controlling and adjusting the rate (i.e., the volume of HVAC) and direction of flow of HVAC fluid from the exhaust port to the exterior of the column in response to local needs and varying conditions.

The column can be rigidly and releasably mounted to the floor or ceiling at various access points in the floor or ceiling of a room. At this access point, heating ventilation, and air conditioning (HVAC) fluid can be supplied to the column from a mobile duct which is part of the subsurface HVAC supply network, and can be connected to the inlet port whereby fluid is conveyed to the interior channel of the column. The HVAC supply network, like the column, is mobile and can be positioned under virtually any access point in the floor or above the ceiling in a room having such floors or ceilings.

This invention is also characterized by a novel combination of prefabricated, modular elements which enable one to create a wide variety of easily assembled work spaces and, at the same time, provide discretely controlled heating, ventilating and air conditioning (HVAC) service as an integral part of such elements, which service can be adapted to a variety of needs and conditions. The modular column which is part of the assembly also fulfills traditional roles usually associated with such columns, i.e., it serves as a structural support; in some cases it can also serve as a means through which the wiring necessary for communication and electrical services can be run.

A popular trend in the design of large and small enclosed interior work spaces of business offices and homes is the installation of portable wall systems, room dividers or partitions so that an open-space area can be readily segregated or partitioned into private or semi-private work areas through the use of modular assemblies. Typically, the assemblies consist of modular wall panels, room dividers or partitions semi-permanently attached to the floor or ceiling. In some instances, these partitions may be supported by modular, mobile pillars, columns or other supporting members. These structures can be readily assembled or disassembled to create a wide variety of temporary completely enclosed or partially enclosed work spaces to suit the needs and desires of the users and occupants. As disclosed in prior art, the support members and wall panels have served as a source for services such as light, radiant heat or electrical and telecommunications networks. For example, wiring for electrical services can be run through hollow conduits in perimeters of walls or through hollow columns, and connected to power sources in either the ceiling or the floor. The electrical leads run through the dividing walls and support columns to the work area and can be located as required for use in powering office machines or providing telephone services and the like.

Perhaps the greatest advantage of these portable modular structures is that the users of the rooms in which they are employed are not limited to fixed, permanently-defined work areas separated by expensive, rigid walls which cannot be readily modified or moved to adapt to changing needs. Using a modular system, the owner/user can easily construct temporary or semi-permanent work areas from light-weight, relatively inexpensive partitions and support columns, and he can change or modify the location and structure of such modular elements to accommodate varying needs and conditions of a business or home, as the case may be. Such modular partition systems have great flexibility and mobility, lending themselves to the creation of many different arrangements for physical work space. However, these assemblies have also created major problems in terms of providing efficient heating, ventilation and air conditioning (i.e., HVAC fluid service) to the constantly changing work spaces which they facilitate and create.

Normally, HVAC service has been provided from fixed locations in a room. Typical services are located along the perimeters of rooms or at fixed locations in the ceiling. Their location has often been dictated by architectural necessity or convenience and not by the needs of the working environment they are supposed to serve. Although vents may be opened and closed and thermostats adjusted, traditional sources of HVAC supply are not readily tailored to supply the needs of changing work environments. Frequent changes in use, configuration and location of work areas causes havoc with the standard, fixed-location HVAC systems. Indeed, the computer industry has addressed the problem by proposing that the supply and venting of HVAC from fixed locations be controlled by expensive and sophisticated computer programs. This palliative has shown some remarkable results, but it treats a symptom of the problem, i.e., the fixed and immobile nature of HVAC systems—not the problem itself.

To alleviate this problem, the present invention, provides a portable HVAC service assembly incorporating a modular support column capable of providing a "task-oriented" (i.e., tailored to the work area in the vicinity of the column) HVAC service supplied from a mobile, subsurface HVAC supply network.

An HVAC supply system carries HVAC fluid from a remote generating source via a subsurface network of ducts to the inlet port which is releasably connected to said network and communicates with the interior channel in the column. The HVAC supplied to the column has a predetermined temperature, humidity, pressure and freshness; the rate and direction with which HVAC fluid is vented from the column is controlled by flow control and deflector devices which are an integral part of the column. Optionally, the temperature and humidity of the HVAC supplied to the inlet port can be locally adjusted in the column by standard heating/cooling elements and humidifying/dehumidifying devices.

Given the modular character of the HVAC service column and the mobility and accessibility of the HVAC supply network under the floor or above the ceiling, a virtually unlimited variety of structures can be set up at any location in a room. Further, the volume of HVAC delivered on a parochial "task-oriented" basis can be closely controlled and efficiently provided using a limited number of simple structural elements. Each element in the modular system can be provided with compatible means for interlocking for the other modular elements, i.e, the service column can have uniform fasteners for releasably interlocking with the partitions or walls having mating fasteners. The columns and partitions, in turn, can releasably interlock with the access floor (or ceiling) to create a rigid, semi-permanent partition or room. The modular structures can be readily assembled or dismantled, removed and relocated. The HVAC supplied by these modular assemblies via the HVAC service and column and subsurface supply network is adapted to discrete demands of an environment by local controls (i.e., a damper, deflector means and, optionally, thermostats, heaters, cooling coils, humidifiers, etc.) in the column to accommodate discrete uses and changing needs adjacent to that particular column. HVAC use can thus be optimized over time and for specific locations and needs, and energy waste can be minimized. Most importantly, the volume and direction of flow of HVAC supplied to areas adjacent to the column to minimize energy demand and maximize the use of the HVAC which is supplied.

B. Description of the Prior Art

In offices, stores and homes, there has been a great increase in the use of modular, portable wall units and partition assemblies used to fabricate rooms or partition work areas. In one conventional form, these units include a combination of columns and panels which can be rigidly interconnected and supported by the columns. Traditionally, the design and architectural considerations have been focused primarily on aesthetics, installation costs and physical characteristics, such as structural strength and integrity and ease of assembly and disassembly. Although these modular partition structures have greatly enhanced adaptibility, portability and utility of interior work space, the design of such assemblies has not adequately addressed the environmental problems created by the change they make possible: specifically, the design of modular assemblies has not focused on now to effectively and efficiently deliver HVAC services to work areas which are, by their nature, constantly changing in size, shape, location and level of use.

A typical partition structure is described in U.S. Pat. No. 3,195,698 to Codrea. The Codrea patent discloses that the structural elements can serve as conduits for electrical wiring. An improved modular partition structure is disclosed in U.S. Pat. No. 3,289,368 to Mark. Again, Mark discloses that the wall panels can contain passage means for electrical conductors or communication service to partitioned areas. As a refinement, U.S. Pat. No. 3,609,211, to VanHerk, discloses a service column which is particularly adapted for providing electrical services from a suspended ceiling to a work area. Finally, U.S. Pat. No. 3,897,820 to Teeter discloses a modular wall panel in which the entire panel serves as an enclosed chamber for transmitting and circulating a heat exchange fluid for controlling the temperature of the wall and, by radiation, the interior of a building adjacent to the wall panel. Although the panel provides heat by radiation to its immediate environment, it does not contemplate the delivery of HVAC services, especially the ventilation and circulation of hot or cold fresh air to a parochial area provided in the present invention.

None of the above-identified modular assemblies provide a means for transmitting and circulating, much less controlling, HVAC fluid services through an element of the assembly to the immediate environment by means of temperature controlled air. As such, these structures do not provide an efficient, flexible, task-oriented solution to the HVAC control and distribution problem commonly encountered in modern or renovated buildings. Specifically, prior art systems are not capable of providing discrete, flexible HVAC services which can be specifically adapted to the changing conditions, locations and needs of parochial work environments, which changes are made even more likely in frequency and more extreme in character as the flexibility and design of modular partition assemblies advances and their use increases.

OBJECTS OF THE INVENTION

It is a general object of the present invention to provide a modular support element which can be easily incorporated in modular partition assemblies and which, at the same time, can supply HVAC services specifically tailored to the work area in the environments of that assembly. It is another object of the present invention to provide a modular partition assembly which can provide HVAC services from a plurality of access points in the floor or ceiling of a room through an integral part of a portable modular partition assembly which can be set up at various locations in the room.

It is another object of the present invention to provide locally-controlled, energy efficient, "task-oriented" HVAC service via an integral element in a modular partition assembly to the work areas immediately adjacent to, and defined by, such assemblies. It is yet another object of the present invention to provide a portable, prefabricated partition assembly which can be easily assembled or disassembled, and which can at the same time, by means integral therewith, supply and locally control the volume and directional flow of HVAC fluid being provided to the environment adjacent to the assembly.

Finally, it is an object of the present invention to provide a mobile, aesthetic, rigid partition structure which can regulate the volume and direction of HVAC fluid supplied to a preselected, parochial area so that the energy required to heat, cool, freshen or humidify air supplied to a given work area is minimized and the use made of such HVAC service is optimized.

SUMMARY OF THE INVENTION

Briefly, a structural assembly according to the present invention includes a modular support column having an interior channel for receiving, carrying and providing discrete, parochial HVAC service to the area adjacent to the column, and which can releasably interlock with a mobile subsurface HVAC supply network. The column is a portable, rigid, elongated, hollow member which serves two basic functions: (1) it acts as a modular structural support member and an integral part of semi-permanent partition assemblies, and (2) it provides HVAC service specifically adapted to the work environment immediately adjacent to such assemblies. One or more walls or partitions can be releasably mounted to the support column and each of these elements can, in turn, be releasably mounted to the floor and/or ceiling of a room. In appropriate situations, the modular support column can be used as a free-standing kiosk (without attached partitions) to provide parochial HVAC service, in which case its support function is not utilized. The subsurface HVAC supply system consists of an HVAC generating source which supplies HVAC fluid to a network of ducts for transport to an inlet port at the base of the interior channel of the modular column. A mobile duct or conduit in the HVAC supply network is releasably attached to the inlet port of the column. The column would be used in a room having an "access" floor or "drop" ceiling, or the equivalent, which provides compatible, modular mounting locations at the access point where the service columns can be erected. The mobile duct of the HVAC supply network can be brought to a plurality of access points for releasable attachment to the inlet port of the interior channel in the column. Additionally, other services, such as electricity and communications networks, can be connected to the column at this point. The inlet port is an integral part of, and communicates with, the interior channel of the column. HVAC fluid having a preselected pressure, temperature, humidity and freshness is provided to the subsurface supply network and flows therethrough to the inlet port of the column, to and through the interior channel of the column, and is vented to the exterior thereof by means of an exhaust port. The flow rate and direction of exhaust are controlled by flow control and exhaust deflector means which are an integral part of the service column.

In the preferred embodiment, illustrated in the drawings and described in detail below, the inlet port is releasably attached to the subsurface HVAC supply network by a mobile, flexible, tubelike duct or conduit which is fastened to the inlet port by a collar and nut arrangement. The flexible mobile conduit can be located at a variety of locations within a region defined by the point of its furtherest extension in all directions. This mobile duct can be reached through an access floor or above a drop ceiling simply by removing the appropriate panel thus enabling one to provide HVAC fluid from a remote generating source through an intermediate, stationary, regional duct to the moveable conduit, and thus to the inlet port of a service column at a variety of mounting locations throughout the room. If a particular mobile duct is not in use, it can be closed off by any conventional plug or flow control device.

DETAILED DESCRIPTION OF PREFERRED EMBODIMENT

Figure 1:
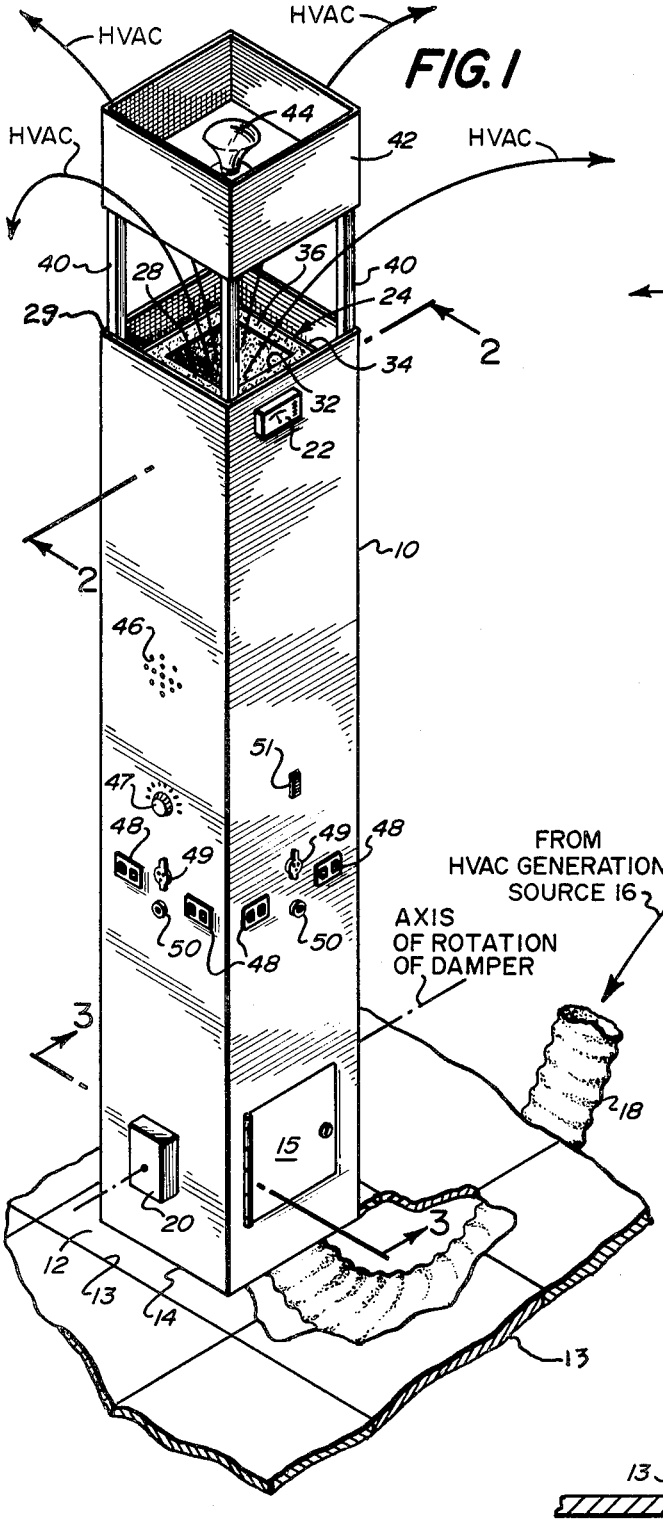
FIG. 1 is a perspective view of the exterior of a modular service column mounted to an access floor and incorporating the basic structural element of this invention.

Referring specifically to the drawings, the preferred embodiment illustrated in FIG. 1 shows the exterior casing of a square, elongated service and support column (10) mounted at its base (14) to a panel (12) in an access floor (13). The cut-away portion of the floor (13) shows a moveable duct or conduit (18), in this case, a flexible tube, for carrying HVAC fluid from a remote generating source (16) (not illustrated) to the base (14) of the column. The connection of the conduit (18) to the interior channel (24) of the column is more fully illustrated in FIG. 3, and described below.

FIG. 1 further illustrates HVAC fluid being vented from an exhaust port (28) of a square-shaped interior channel (24) near the top of the modular column (29). Also, a thermostat (22) is located near the top and at the exterior thereof. The column casing (10) may be fabricated from any durable material such as sheet metal, plastic, wood, etc., to suit the needs and convenience of the user. In the preferred embodiment, a cosmetically acceptable form of sheet metal is used.

HVAC generated at a remote source (16) is delivered to the column by the moveable duct (18). The fluid is confined within the interior wall (32) of the channel (24) until it exits via the exhaust port (28). In preferred form, the inside wall (36) of the channel (24) is composed of an insulating material to reduce fluid noise. The exterior wall (34) of the channel (26) is made of sheet metal to provide stability and support for the channel. Other suitable materials possessing the necessary strength and durability may be used to fabricate the interior channel, depending upon physical requirements and the needs of the system.

FIG. 1 also illustrates three (of four) support struts (40) supporting a light housing (42) and a light (44). The housing (42) holds a deflector (30), as more fully shown in FIG. 2. The struts (40) and housing (42) are fabricated from sheet metal, although other materials may be used depending on the use of the assembly and aesthetic requirements.

At the base of the column (10) in FIG. 1, there is shown a symbolic damper motor (20) and a door (15) which provides access to the interior of the column (10). In the preferred form, the damper motor is located inside the casing (10) although the choice of site is a matter of convenience and engineering requirements. The damper is illustrated in detail in FIG. 3 and described below. The damper serves to control the rate of flow (or volume) of HVAC carried through the channel and, thus, the rate at which HVAC is vented from the column. By varying the rate of flow, the volume of preconditioned HVAC supplied to the exterior work space and room can be controlled as required. The damper may be manually controlled or automatically actuated in response to the thermostat (22). Other well known flow control devices may be used in place of the damper mechanism described herein.

Further, in FIG. 1, there are illustrated various ancillary services, i.e., speakers (46) for intercom or radio volume control (47) for the same, electrical outlets (48) for appliances, telephone cable female jacks (49), cathode ray tube (CRT) supply (50), and a light switch (51). Finally, the column can include various supplementary devices (not shown) for locally adjusting the humidity and temperature of the HVAC supplied to the channel (34) before venting to the exterior. The type and location of such devices is dictated largely by their operating requirements and the convenience of the fabricator.

Figure 2:
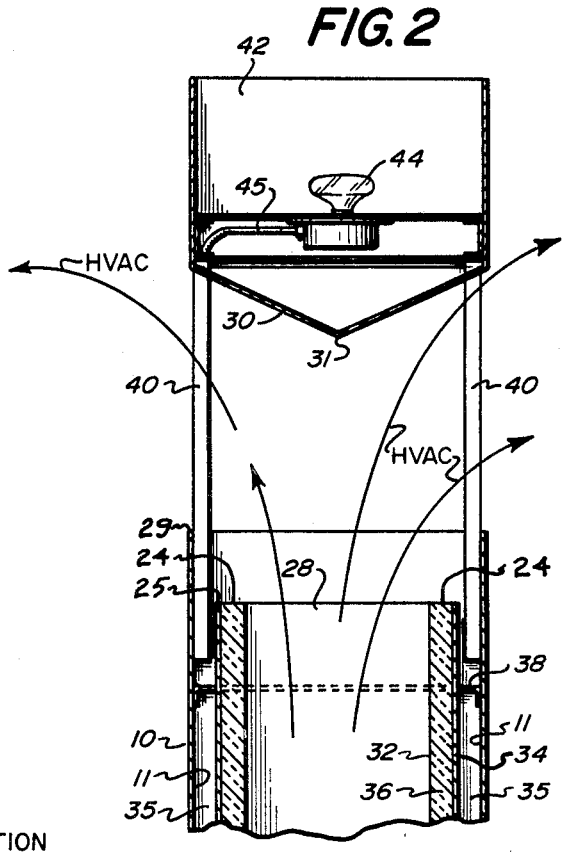
FIG. 2 is a detail sectional side view of the top portion of a modular service column, showing an exhaust port and deflector according to the present invention as seen along line 2—2 in FIG. 1.

FIG. 2 is a detail cross-sectional view of the top part of the column (10) seen along line 2—2 of FIG. 1. The figure more clearly illustrates the positioning and mounting of the exterior wall (34) of the interior channel (24) and its exhaust port (28) relative to the interior wall (11) of the support and service column (10). The exterior wall (34) of the interior channel (24) is fixedly attached by means of a brace (38) to the interior of the column casing (11). Typically, the brace can be attached to the channel wall (35) and casing wall (11) by any suitable means such as welding, gluing or fastening, depending upon the type of materials used and the physical stresses to be placed on the column and channel. In the preferred embodiment, the braces (38) abut a metal exterior wall (34) of the interior channel (24) and are welded to the interior wall (11) of the exterior metal column (10). The number and location of braces required would depend on the size and weight of the column and channel, the types of materials used, and the stresses placed on the column and interior channel. The cross-hatched portion (36) of the interior channel (24) is an insulating material which, in turn, defines the interior wall (32) of the channel.

There is an open space (35) between the channel exterior (34) and the interior of the metal casing (11) which can function as an electrical raceway. The top of the interior channel (25) is recessed below the top (29) of the column casing (10) as a matter of cosmetic convenience and for aesthetic purposes. Struts (40) are attached to the top (29) of the column to support the deflector (30) and light housing (42). A light (44), light power cable (45) and the apex (31) of the deflector (30) in the shape of an inverted pyramid are shown. It can be seen from this illustration that the direction of flow of the HVAC as it leaves the exhaust port (28) will be determined by the shape, location and configuration of the deflector (30). In the preferred embodiment, the deflector is a symmetrical, four-sided, inverted pyramid with its apex (31) located above the center of the exhaust port (28) of the channel member, thus deflecting the HVAC in uniform, omni-directional pattern. In the illustrated embodiment, the interior channel (24) is about 10 inches square and the column casing (10) is about 16 inches square. The housing (42) located approximately 13 inches above the top (29) of the column casing. The flat faces of the deflector (30) facilitate the laminar flow of the HVAC toward the horizontal as shown by the arrows. Of course, it can be readily appreciated that a number of symmetrical or asymmetrical interior channels and one or more exhaust ports of varying shape could be provided in the column without departing from the spirit of the invention. Further, the size, shape, and location and number of deflectors could be greatly varied depending on the use, size and location of the column, channel and the requirements of the user. The preferred form illustrated in FIGS. 1, 2 and 3 was selected to suit the environment in which it is to be used and also for its simplicity, symmetry and aesthetic appeal.

The assembly can be used alone, as a standing kiosk, or as a support column with a number of walls, partitions, room dividers attached to it. The column illustrated in FIGS. 1 through 6 extends upward from the floor and is about 90 inches high, not reaching the ceiling (not illustrated) in a relatively large, high-ceiling (e.g., 14 feet) room or enclosed area. The column may be designed to protrude downward from a ceiling or it may extend from and attach to both ceiling and floor; again, its location and form will depend on use, location, engineering and HVAC requirements, aesthetics, etc. As long as it can serve the function of providing portable, discretely controlled HVAC service from a mobile subsurface supply system (illustrated in FIGS. 3 and 6) as described below, and acts as a possible support for modular partition structures, it will contain the basic elements of this invention.

Figure 3:
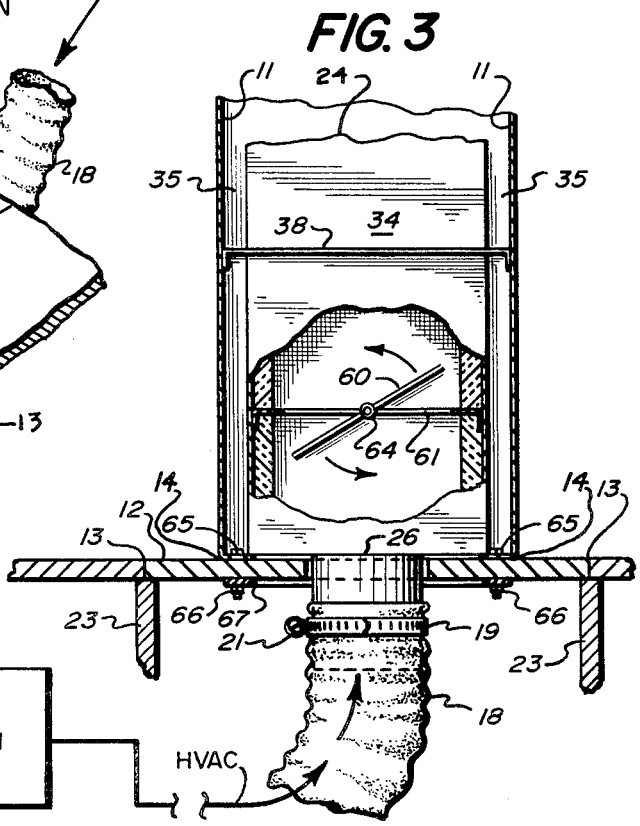
FIG. 3 is a detail sectional side view of the bottom portion of a service column as seen along line 3—3 of FIG. 1, illustrating a damper in the interior channel of the column, the mounting of the column to access flooring and connection of the inlet port of the channel to a conduit in the subsurface HVAC supply system.

FIG. 3 shows a cut-away detail cross-sectional view of the bottom part of the service column (10) as seen when viewed along line 3—3 of FIG. 1. Again, a brace (38) is shown which holds the exterior wall (34) of the interior channel (24) rigidly in place. The base (14) of the column casing (10) is flanged inward and attached by bolts (65) and (66) to the access floor panel (12). The panel is removeable from the floor (13) to gain access to the mobile duct (18) of the subsurface HVAC supply system. The mobile duct (18), in this case, is flexible tubing and it is attached to the inlet port (26) of the interior channel (24) by means of metal collar (19) and lock nut (21). The floor panel (12) is supported by bracing (23) of sufficient height to allow the HVAC service, i.e., the HVAC supply duct to be run below the room floor (13). A mounting brace or platform (67) assists in securing the base of the column (14) to the access floor panel (12).

Finally, FIG. 3 depicts a damper in partially open (60), and in a closed (61), position. The damper rotates about an axial pivot (64) which is controlled by the damper motor (20) shown in FIG. 1. The damper can be used to control the rate of flow of HVAC fluid through the interior channel (24) of the column (10) from a completely closed (no flow) mode (e.g., position illustrated by 61), through varying degrees of openness (e.g., position illustrated by 60), to a completely open mode in which the damper (60) would be vertically oriented within the channel (24).

The column can be moved to another access location in the room, by lifting the column (10) and the attached panel (12) up from the floor and placing the assembly at another access point. In that process, the metal collar (19) and lock nut (21) are opened to sever the connection between the mobile duct (18) and the inlet port (26) and a reconnection of the two elements is made at the new location. The mobile duct (18) when not in use can be sealed or shut off by conventional means and a plain floor panel (12) without the column mounted and the cut-out for the inlet port (26) is inserted in the floor to present a homogenous surface. The service column can be mounted and connected to the subsurface HVAC at virtually any location in the room having an access panel (12) and to which a mobile HVAC system and duct (18) can be run.

Figure 4:
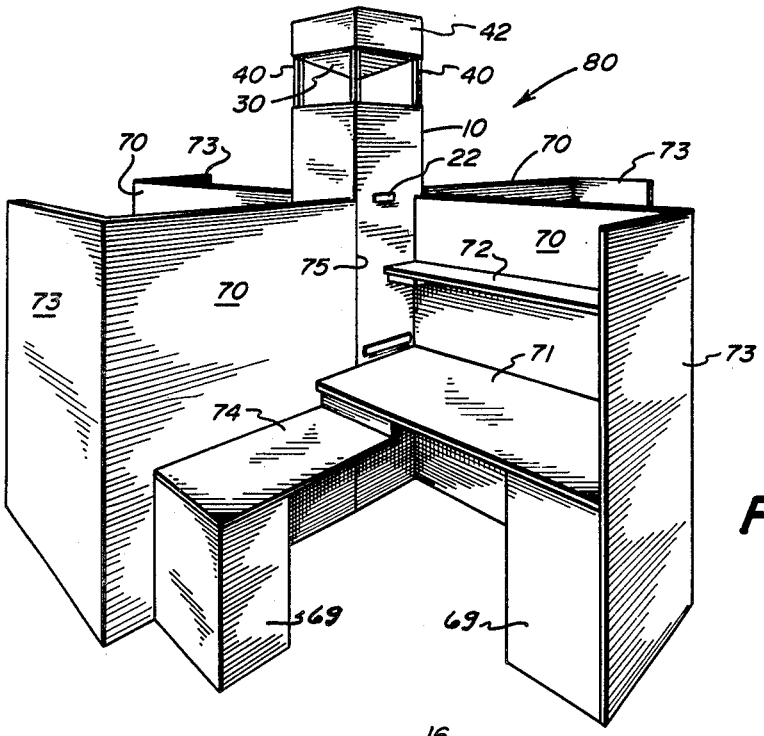
FIG. 4 is a perspective view of the service column connected to four modular wall units which provide four semi-private work areas adjacent to the column.
Figure 5:
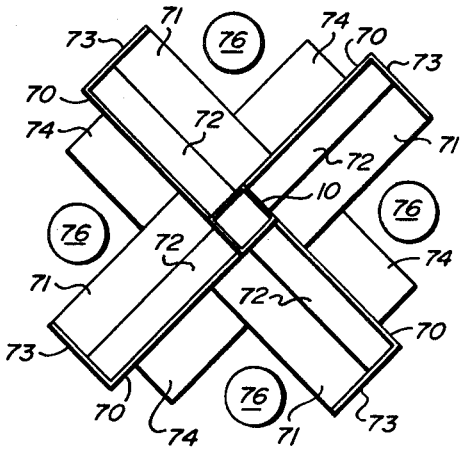
FIG. 5 is a top view of the modular assembly column including partitions or walls as illustrated in FIG. 4.

FIG. 4 shows the service column (10) incorporated into a symmetrical modular partition system having contiguous modular walls (70) and (73) which, when attached in quadrants around the column, depict a pin-wheel form (80) as seen from above in FIG. 5. The walls (70) and (73) can be mounted on a compatible, modular fastener (not shown) on the edge (75) of the column to form work stations. In FIG. 4, four work stations are formed by the eight walls (70) and (73) and column (10). Typically, the wall sections also can have appended to them one or more desks (71) and (74), and shelving (72), with or without lighting. Drawers or filing cabinets (69) may also be provided. It can be seen from this perspective view that the columns (10) and subsurface HVAC supply (as shown in FIGS. 1 and 3) will provide immediate and efficient HVAC flow to the work space. If vacant, the damper can be set in closed position (61); as illustrated in FIG. 3, to minimize waste of energy. FIG. 5 illustrates from above the pin-wheel formation shown in FIG. 4. Additionally, seating (76) for each work quadrant is also shown.

Figure 6:
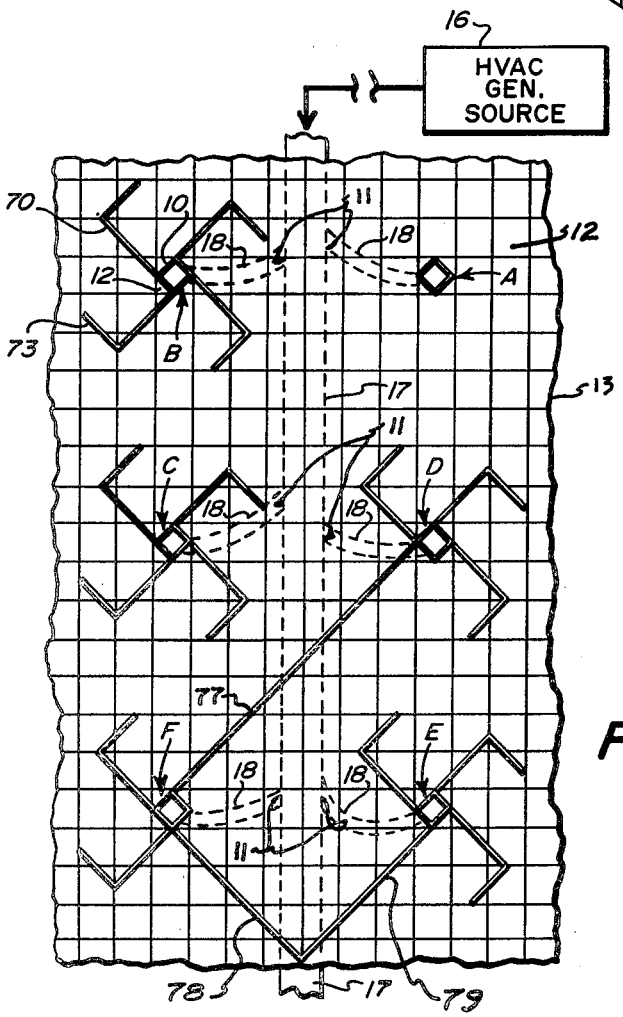
FIG. 6 is a top plan view of six spaced apart modular columns acting as a kiosk or as supports for a variety of partition assemblies wherein the service columns are mounted on access flooring at a 45° orientation with respect to the floor panels and the subsurface HVAC supply is illustrated by broken lines.

FIG. 6 depicts six columns in a variety of applications or arrangements: in the case of A, as kiosk standing alone; in the case of B and C, as part of two side by side pin-wheel partition assemblies; and in the case of D, E and F as corner columns in a partially enclosed room defined by wall (77, 78 and 79). Also, FIG. 6 shows the subsurface HVAC supply system consisting of a network of stationary regional ducts (17) and mobile flexible ducts (18) which connect to the inlet ports (as depicted in FIG. 3, number 26) of the service columns A, B, C, D, E and F. The duct network is supplied by one or more HVAC generating sources (16). Each of the panels in the access floor (12) can be removed and the mobile ducts (18) moved underneath to facilitate connection of columns (10) mounted above that access location. The 45° orientation of the square columns with respect to the panel grid as illustrated in FIG. 6 is a matter of convenience; the columns may be rotated to direct HVAC and support structural elements as desired.

The columns (A, B, C, D, E and F) illustrated in FIG. 6 can be turned "on" or "off" by manually or automatically actuating the damper motor (20) (FIG. 1) in response to the thermostat (22) or personal desire. The volume of HVAC required at any given work station will depend on its use, personal preference, and the HVAC characteristics of ambient conditions in the room or enclosed area which the column or columns service.

Although the primary function of the column is to exhaust discretely controlled volumes of HVAC fluid into the room to satisfy local demand; it can also be operated in reverse to withdraw ambient fluids from a room by reversing the net pressure in all or a part of the subsurface supply system. The operation of a multiplicity of columns can be optimized by hooking up their thermostats (22) to a central computer so that each column efficiently cooperates with other column assemblies at various locations in accordance with a programmed or spontaneously selected plan.

The modular partition structures shown in FIG. 6 can be readily disassembled and the columns moved to access points other than the six locations illustrated. The moveable duct (18) is simply disconnected from the inlet port (26) by opening the fastening collar (19) (as illustrated in FIG. 3); the duct (18) is then plugged or shut off by conventional means (not shown) or moved to the new location and reattached to the inlet port (26) at the new access point, assuming its within the region served by that duct. The flexible, moveable ducts (18) are attached to the regional stationary duct at a plurality of locations (11) so that virtually every panel (12) in the floor (13) provides an access point for mounting the column (10).

The HVAC generating source (16) as referred to herein, and specifically illustrated in FIGS. 1, 3, and 6, can be comprised of one or more standard heating, air conditioning, and venting systems which are commercially available for homes, office buildings and the like. The unit or units can be selected by one skilled in the art and will depend on ambient requirements of the enclosed space or spaces served, the particular design of the HVAC distribution system adapted, and other economic or engineering considerations.

In the drawings and specifications, there has been set forth a preferred embodiment of the invention, and although specific terms are employed, they are used in a generic and descriptive sense only and not for purposes of limitation.

References are made herein to the column (10) being attached to "a floor," and the drawings illustrate such an embodiment; this is not to be considered limiting. For example, the column can also be mounted to both a ceiling and floor, at least one of which has a moveable subsurface HVAC supply system and the required physical characteristics necessary to support the column, without departing from the spirit of the invention.

What is claimed is:

1. A dual-purpose, modular service assembly for use in a room having a moveable, accessible subsurface HVAC supply system, which assembly provides support to modular partition structures erected in said room and also provides discretely-controlled HVAC fluid service to the area adjacent to said structures in response to varying, local conditions and demands, said assembly comprising:

(a) a hollow, portable modular support and HVAC service column having an interior channel extending longitudinally therethrough and adapted to carry HVAC fluid introduced into said channel through an inlet port at its base, said inlet port being releasably connected to said HVAC supply system;

(b) an exhaust port integral to said channel and communicating with the exterior of said column for venting the HVAC fluid from said channel to area adjacent to the exterior of said column;

(c) deflector means integral with said channel and column and in a relatively close spatial relation with said exhaust port so that it opposes the HVAC exiting from said channel and directs it radially outward from a central point in the channel;

(d) a fluid control means integral with said channel and positioned between said inlet port and exhaust port for discretely controlling the rate at which HVAC flows through said channel by opening and closing access therethrough, thereby controlling the rate at which HVAC fluid is exhausted from said column;

(e) fastening means integral with said column for releasably mounting the base thereof to a floor of said room at any one of a plurality of access points at which the moveable, accessible subsurface HVAC supply system can be located, so that the column will stand in fixed, rigid, semipermanent connection to said floor and the inlet port of the channel is positioned for releasable attachment to the HVAC supply system beneath the floor;

(f) second fastening means for releasably connecting said inlet port to said HVAC supply system so that HVAC fluid can be carried from said supply system to the inlet port of said channel; and (g) supplementary conditioning means, integral with said column, for locally adjusting the temperature and humidity of said HVAC fluid after it has been supplied to the inlet port of said column.

2. An assembly according to claim 1 wherein the subsurface HVAC supply system is a network of communicating ducts comprised of a regional, stationary duct to which the HVAC is supplied from a remote generating source, and a mobile, flexible duct attached to said stationary duct and connected, by releasable attachment, to the inlet port of said column for conveying HVAC thereto.

* * * * *